US011631944B2

(12) United States Patent
Lybrand

(10) Patent No.: US 11,631,944 B2
(45) Date of Patent: Apr. 18, 2023

(54) INSULATION DISPLACEMENT CONTACT SYSTEM

(71) Applicant: KYOCERA AVX Components Corporation, Fountain Inn, SC (US)

(72) Inventor: Brent Lybrand, Fountain Inn, SC (US)

(73) Assignee: KYOCERA AVX COMPONENTS CORPORATION, Fountain Inn, SC (US)

( * ) Notice: Subject to any disclaimer, the term of this patent is extended or adjusted under 35 U.S.C. 154(b) by 0 days.

(21) Appl. No.: 17/539,472

(22) Filed: Dec. 1, 2021

(65) Prior Publication Data

US 2022/0255247 A1 Aug. 11, 2022

Related U.S. Application Data

(60) Provisional application No. 63/148,413, filed on Feb. 11, 2021.

(51) Int. Cl.

| | |
|---|---|
| ***H01R 9/053*** | (2006.01) |
| ***H01R 9/22*** | (2006.01) |
| ***H01R 4/2416*** | (2018.01) |
| ***H01R 4/24*** | (2018.01) |

(52) U.S. Cl.

CPC ..... *H01R 9/053* (2013.01); *H01R 9/223* (2013.01); *H01R 4/24* (2013.01); *H01R 4/2416* (2013.01)

(58) Field of Classification Search

CPC ..... H01R 9/053; H01R 9/223; H01R 4/24; H01R 4/2416; H01R 4/2425; H01R 4/2429; H01R 4/2433

See application file for complete search history.

(56) References Cited

U.S. PATENT DOCUMENTS

| | | | | |
|---|---|---|---|---|
| 6,050,845 | A * | 4/2000 | Smalley, Jr. ..... | H01R 12/515 439/417 |
| 9,444,159 | B2 * | 9/2016 | Lappoehn ..... | H01R 12/675 |
| 9,543,664 | B2 * | 1/2017 | Sabo ..... | H01R 4/2433 |
| 2004/0053532 | A1 | 3/2004 | Jones | |
| 2011/0039452 | A1 | 2/2011 | Cheng | |
| 2012/0238127 | A1 | 9/2012 | Bishop | |
| 2016/0072200 | A1 | 3/2016 | Sabo | |
| 2019/0044254 | A1 * | 2/2019 | Lybrand ..... | H01R 4/2456 |

FOREIGN PATENT DOCUMENTS

| | | |
|---|---|---|
| KR | 101231825 | 2/2013 |

OTHER PUBLICATIONS

International Search Report and Written Opinion on PCT/US2021/061357 dated Mar. 23, 2022.

* cited by examiner

*Primary Examiner* — Oscar C Jimenez
*Assistant Examiner* — Paul D Baillargeon
(74) *Attorney, Agent, or Firm* — Foley & Lardner LLP

(57) ABSTRACT

An insulation displacement contact system includes a first insulation displacement contact, a second insulation displacement contact, and a cover having a first portion over the first insulation displacement contact and a second portion over the second insulation displacement contact. The cover includes a retention gap between the first portion and the second portion to engage the cover with a first pair of prongs of the first insulation displacement contact. The first portion of the cover includes a first ledge and a second ledge configured to engage the cover with a second pair of prongs of the first insulation displacement contact.

19 Claims, 15 Drawing Sheets

INSULATION DISPLACEMENT CONTACT SYSTEM

CROSS-REFERENCE TO RELATED APPLICATIONS

The present application claims priority to U.S. Provisional Patent Application No. 63/148,413 filed Feb. 11, 2021, the contents of which are incorporated by reference herein in their entirety.

FIELD

The present application relates generally to the field of electrical connectors, and more particularly to electrical connectors configured to form electrical connection between multiple electrical components.

BACKGROUND

The following description is provided to assist the understanding of the reader. None of the information provided or references cited are admitted to be prior art.

Various types of connectors are used for forming connections between a wire and an electronic or electrical component. These connectors are typically available as sockets, plugs, and shrouded headers in a vast range of sizes, pitches, and plating options. Traditionally, for a user to mechanically and electrically connect a wire to an electrical component, the user must correctly position the wire in relation to the electrical component for forming the electrical connection. This process can be tedious, inefficient, and undesirable. The wire-to-component connection may fall apart or short out unexpectedly due to incorrect placement during assembly, and could be hazardous or expensive, especially when connecting the wire to an expensive component (e.g., a printed circuit board (PCB)). Thus, a quick, efficient, and reliable means of accurately positioning a variety of sizes of wires in a variety of applications is needed.

SUMMARY

The devices and methods of this disclosure each have several innovative aspects, no single one of which is solely responsible for the desirable attributes disclosed herein.

In accordance with some embodiments of the present disclosure, an insulation displacement contact system is disclosed. The insulation displacement contact system includes a first insulation displacement contact, a second insulation displacement contact, and a cover having a first portion over the first insulation displacement contact and a second portion over the second insulation displacement contact. The cover further includes a retention gap between the first portion and the second portion to engage the cover with a first pair of prongs of the first insulation displacement contact and the first portion of the cover includes a first ledge and a second ledge configured to engage the cover with a second pair of prongs of the first insulation displacement contact.

In accordance with some embodiments of the present disclosure, a cover for an electrical contact is disclosed. The cover includes a first portion having a first top wall, a first side wall, and a second side wall, a second portion having a second top wall, a third side wall, and a fourth side wall, and a retention gap between the first portion and the second portion. The first portion is configured to be assembled over a first contact connected to an electrical component, the second portion is configured to be assembled over a second contact connected to the electrical component, the first side wall includes a first ledge opposite the retention gap such that the first ledge is configured to engage with a first flange of the first contact, and the second side wall includes a second ledge opposite the retention gap such that the second ledge is configured to engage with a second flange of the first contact.

In accordance with some embodiments of the present disclosure, a method is disclosed. The method includes positioning a carrier having a first contact and a second contact engaged therein over an electrical component for assembling the first contact and the second contact onto the electrical component, assembling the first contact and the second contact onto the electrical component, and disengaging the carrier from the first contact and the second contact upon assembling the first contact and the second contact onto the electrical component. The method also includes engaging a cable between the first contact and the second contact upon disengaging the carrier and securing a cover over the cable, the first contact, and the second contact by engaging a first ledge of the cover with a first prong of the first contact, engaging a second ledge of the cover with a second prong of the first contact, engaging a first engagement surface of the cover defined in a retention gap between a first portion and a second portion of the cover with a third prong of the first contact, and engaging a second engagement surface of the cover defined in the retention gap with a fourth prong of the first contact.

DETAILED DESCRIPTION

Figure 1A:
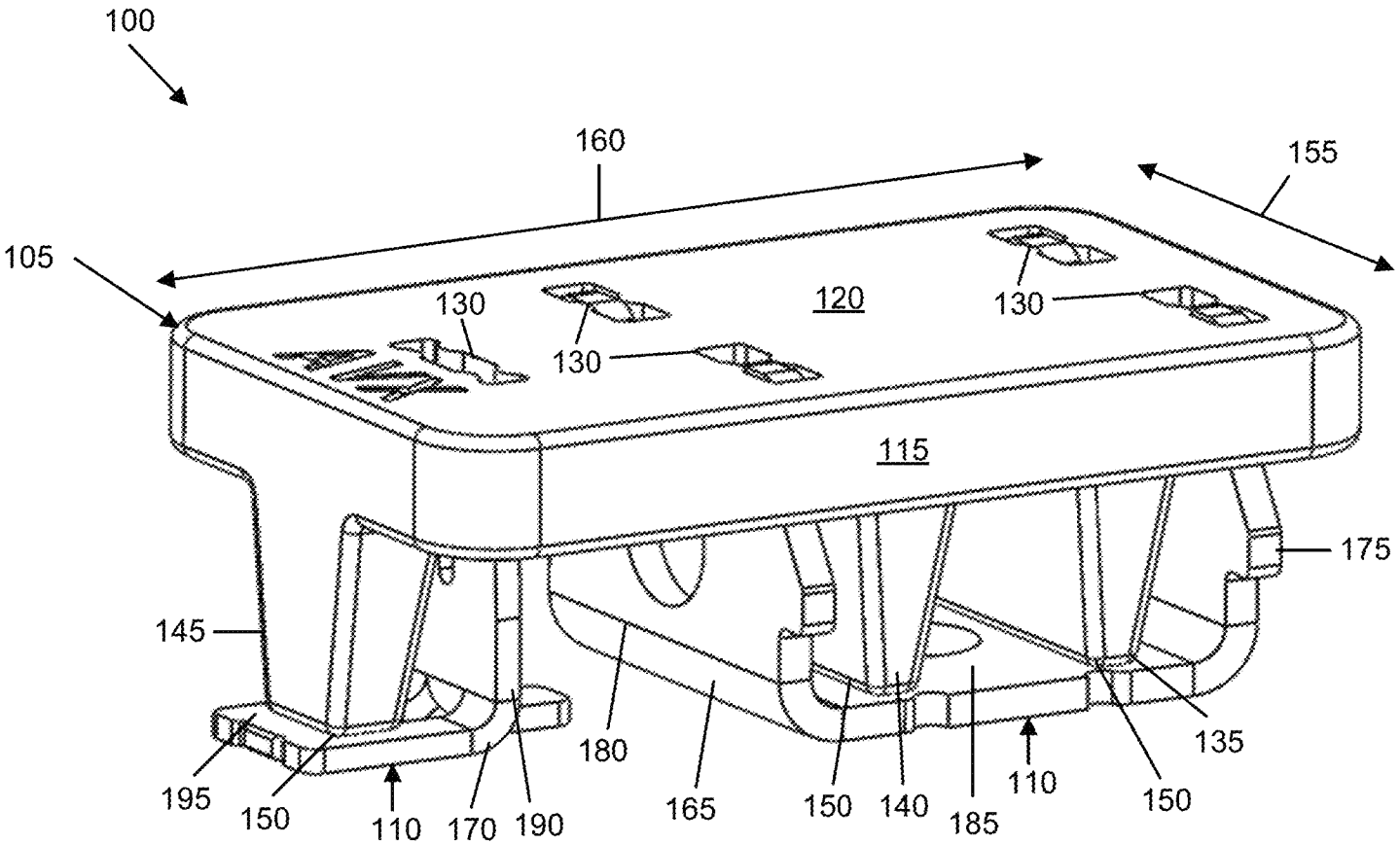
FIGS. 1A and 1B are examples of a carrier having a first and second insulation displacement contact (IDC) secured therein to facilitate connection of the first and second IDC with an electrical component, in accordance with an illustrative embodiment.

Reference will now be made to various embodiments, one or more examples of which are illustrated in the figures. The embodiments are provided by way of explanation of the invention and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is an IDC system that allows for quick termination of a coaxial cable to an electrical component, such as a printed circuit board ("PCB"), ground plane, contactor, bus bar, or any other conductive surface. The IDC system terminates the coaxial cable without the need for plastic insulation, and provides adequate electromagnetic interference (including radio frequency (RF)) shielding and mechanical strain relief. The DC system replaces the plastic insulation with air creating a more uniform electromagnetic environment. Thus, the DC system allows for efficient and rapid creation of an electrical connection between a wire and an electrical component.

Specifically, the IDC system includes a pair of electrical contacts and a strain-relief cover assembled over the pair of electrical contacts. The strain-relief cover protects the pair of electrical contacts and a coaxial cable installed between those electrical contacts from external elements such as debris, dust, etc., as well as provides mechanical support to the electrical contacts and the cable. Further, in some embodiments, the strain-relief cover may be configured such that at least a portion of the strain-relief cover is electrically connected to a first electrical contact of the pair of electrical contacts. The strain-relief cover also provides electromagnetic interference shielding to a second one of the pair of electrical contacts from the first electrical contact. In some embodiments, the strain-relief cover may be assembled over the second electrical contact such that an air gap exists between the cable over the second electrical contact and the strain-relief cover. The air gap may serve as insulation for the cable, thereby avoiding the need for plastic insulation.

Additionally, the present disclosure provides a novel and easy mechanism for assembling the pair of electrical contacts on the electrical component, for assembling the cable between the pair of electrical contacts, and for assembling the strain-relief cover over the pair of electrical contacts. Specifically, the present disclosure provides a carrier within which the pair of electrical contacts may be secured to properly axially position and orient the pair of electrical contacts over the electrical component without needing to manually handle (e.g., touch) the pair of electrical contacts. The carrier also ensures that the pair of electrical contacts remain in proper positioning during the assembly (e.g., soldering) of the pair of electrical contacts on the electrical component without moving. The carrier also ensures a proper and consistent spacing between the pair of electrical contacts on the electrical component to reduce electromagnetic interference. Upon assembling the pair of electrical contacts on the electrical component, the carrier may be removed.

Similarly, in some embodiments, the present disclosure provides an easy and convenient mechanism to install a coaxial cable between the pair of electrical contacts without needing to manually handle (e.g., touch) the coaxial cable. The present disclosure provides a seating tool having a cavity therein. The coaxial cable may be inserted within the cavity of the seating tool. The cavity may be specifically designed to transfer the coaxial cable from the seating tool to the pair of electrical contacts when a downward force towards the electrical component is exerted on the seating tool. The seating tool also enables consistent and proper vertical and axial positioning of the coaxial cable between the pair of electrical contacts. Upon assembling the coaxial cable between the pair of electrical contacts, the present disclosure provides an easy and convenient mechanism to install the strain-relief cover over the coaxial cable without needing any special tools or devices. For example, in some embodiments, the strain-relief cover may be configured with features (e.g., ledges, engagement surfaces) that interact with features (e.g., flanges) on one of the pair of electrical contacts to snap or friction fit the strain-relief cover over the pair of electrical contacts.

Figure 1B:
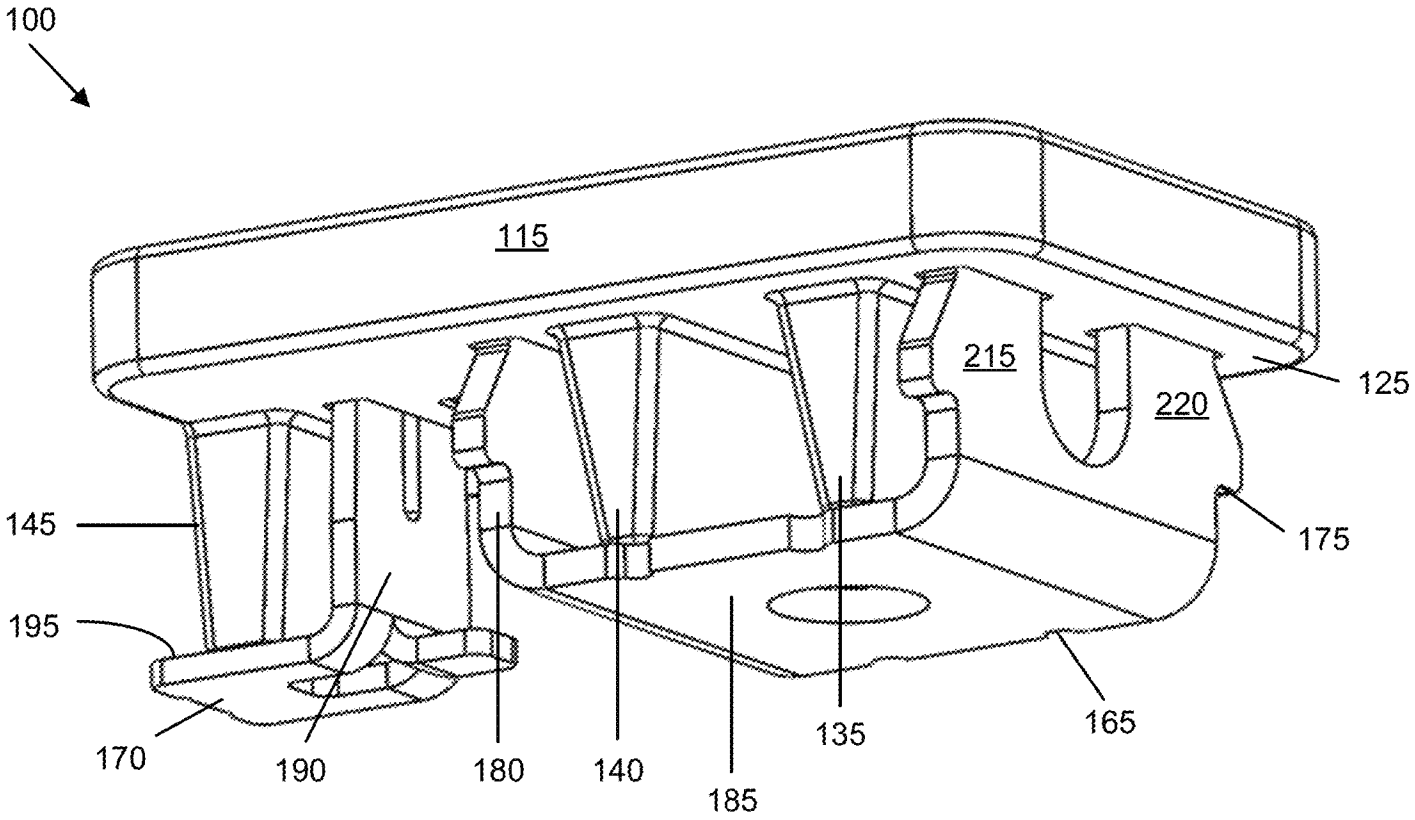

FIGS. 1A and 1B show part of an DC system in accordance with some embodiments of the present disclosure. The IDC system may include a carrier, a seating tool, and a strain relief cover. Thus, FIGS. 1A and 1B show an example of a carrier system 100, while the seating tool and the strain relief cover are discussed further below. Specifically, FIG. 1A shows a top perspective view of the carrier system 100, while FIG. 1B shows a bottom view of the carrier system. The carrier system 100 includes a carrier 105 and electrical contacts 110. The carrier 105 may be configured to hold the electrical contacts 110 securely while positioning the electrical contacts on an electrical component (e.g., a PCB) for assembly. Upon assembling the electrical contacts 110 on the electrical component, the carrier 105 may be removed.

Figure 2:
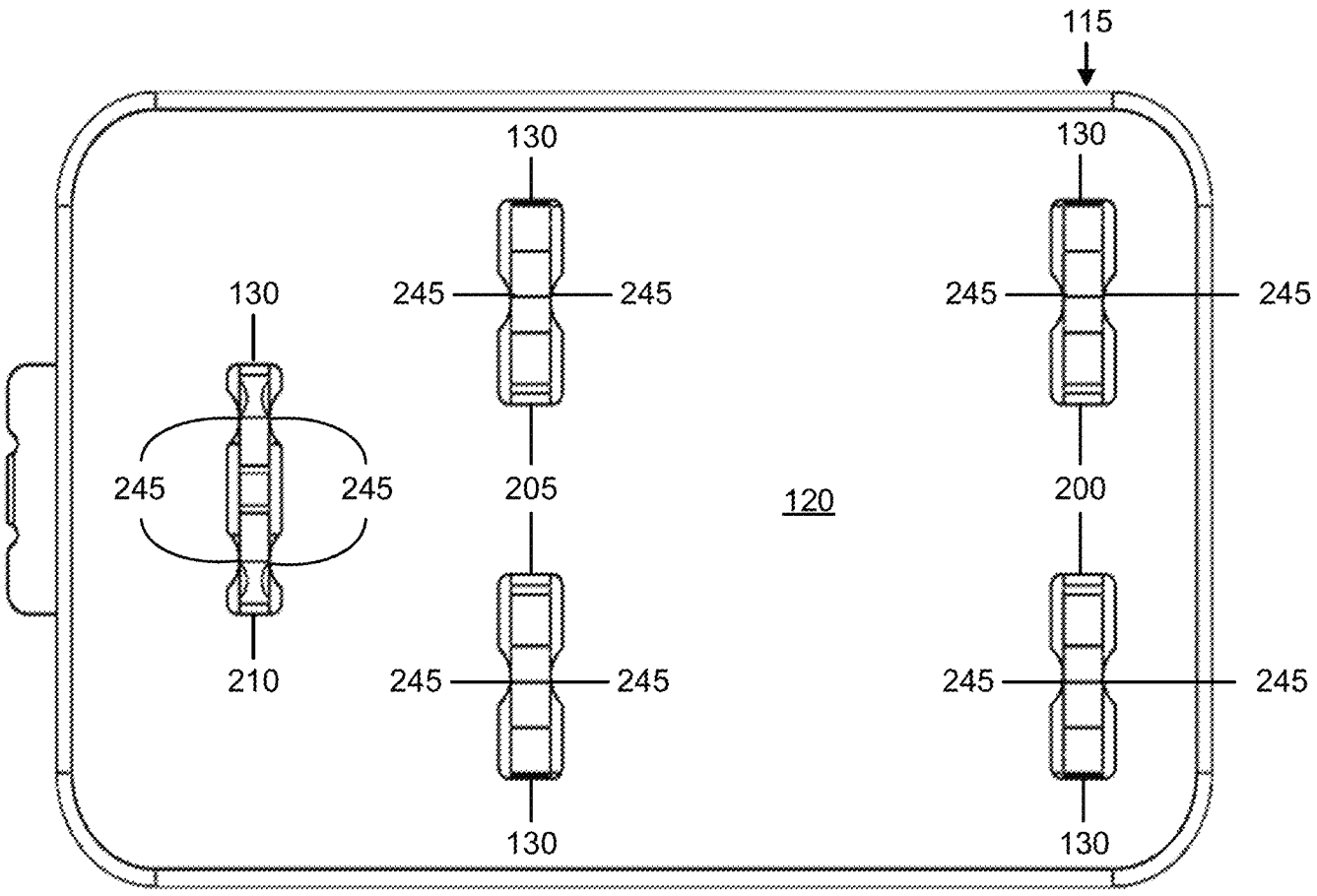
FIG. 2 is a top view of the carrier of FIGS. 1A and 1B, in accordance with an illustrative embodiment.

In some embodiments, the carrier 105 may be composed of plastic. In other embodiments, the carrier 105 may be composed of other non-conductive, non-metal, and/or other suitable materials. In some embodiments, the carrier 105 may be disposable. The carrier 105 may include a base 115 having a top surface 120 and a bottom surface 125 (see FIG. 1B). Although the base 115 is shown to have a rectangular shape, in other embodiments, the base may assume other shapes and sizes. The top surface 120 of the base 115 may have retention slots 130 to receive and secure the electrical contacts 110. FIG. 2, which shows the top surface 120 of the carrier 105, including the retention slots 130, in greater detail, is discussed below. The bottom surface 125 of the carrier 105 includes one or more legs extending therefrom and away from the top surface 120. In some embodiments, the bottom surface 125 may have three legs 135, 140, 145 extending therefrom. In other embodiments, greater than or fewer than three legs may be provided. In some embodiments, the base 115 and the legs 135-145 may be integrally formed. In other embodiments, the base 115 and the legs 135-145 may be separate components joined together in operational association. In some embodiments, the height of the legs 135-145 may be configured such that a bottom surface of each of the electrical contacts 110 is in a single plane. Thus, depending upon the height, width, and/or thickness of each of the electrical contacts 110, each of the legs 135-145 may have a same (or similar) height or varying heights to ensure that those electrical contacts rest on the same plane.

Further, in some embodiments, each of the legs 135-145 may also extend along a width direction 155 of the base 115. For example, and as shown in FIGS. 1A and 1B, in some embodiments, each of the legs 135-145 may have a tapering shape such that a wider portion of the legs extends along the width direction 155 adjacent to the bottom surface 125 of the base 115 and gradually tapers down towards the electrical contacts 110. In other embodiments, the shape of one or more of the legs 135-145 may be different from that shown. In some embodiments, the width direction 155 may be the shorter edge of the base 115. In other embodiments, one or more of the legs 135-145 may be positioned along a length direction 160 of the base 115. In some embodiments, the length direction 160 may be the longer edge of the base 115.

Additionally, in some embodiments, each of the legs 135-145 may be sized to extend a substantial width (e.g., in the width direction 155) of the electrical contacts 110. Specifically, in some embodiments, the width of a bottom surface 150 of each of the legs 135-145 may be sized in accordance with the width of the electrical contacts 110 that each of those legs is designed to support. Thus, in some embodiments, each of the legs 135-145 may be sized differently. Further, in some embodiments, each of the legs 135-145 may be spaced apart from one another along the length direction 160 of the base 115. In some embodiments, the spacing between the legs 135-145 may be based upon the configuration of the electrical contacts 110. For example, in some embodiments, the electrical contacts 110 may include a ground contact 165 and a signal contact 170. In some embodiments, the ground contact 165 may be considered a first contact or a first insulation displacement contact and the signal contact 170 may be considered a second contact or a second insulation displacement contact. In some embodiments, each of the first contact and the second contact may be an insulation displacement contact configured to establish electrical connection between a wire or cable (e.g., an insulated wire or cable) and an electrical component.

In some embodiments, the ground contact 165 may have a pair of legs 175 and 180 that extend upwards towards the bottom surface 125 of the base 115 from a floor 185 of the ground contact. The shape and configuration of the legs 175 and 180 may be better seen in FIG. 4. The legs 175 and 180 may be spaced apart from one another. Thus, the spacing between the legs 135 and 140 may be based upon (e.g., less than) the spacing between the legs 175 and 180. In some embodiments, the signal contact 170 may also include a leg 190 extending upwards towards the bottom surface 125 of the base from a floor 195 of the signal contact. In some embodiments, the signal contact 170 may be spaced apart from the ground contact 165. In some embodiments, the spacing between the ground contact 165 and the signal contact 170 may be determined by modeling and simulation to provide desirable radio frequency characteristics (e.g., shielding). Thus, in some embodiments, the spacing between the legs 140 and 145 may be designed to allow the ground contact 165 and the signal contact 170 to achieve the desired spacing, and therefore, the desired radio frequency characteristics. Furthermore, the spacing of the legs 140 and 145 may ensure a consistent spacing each time between the ground contact 165 and the signal contact 170 on the electrical component.

Thus, the carrier 105 may include the base 115 having the legs 135-145 projecting therefrom. The base 115 and the legs 135-145 may be configured to engage the legs 175, 180, 190 of the ground contact 165 and the signal contact 170 for positioning on an electrical component for assembly. FIG. 2 shows the engagement of the legs 175, 180, 190 on the base 115 in greater detail. As discussed above, the top surface 120 of the base 115 includes the retention slots 130. The retention slots 130 are configured to secure the legs 175, 180, 190 of the ground contact 165 and the signal contact 170. Specifically, retention slots 200 may be configured to engage the legs 175 of the ground contact 165, retention slots 205 may be configured to engage the legs 180, and retention slot 210 may be configured to engage the leg 190. Thus, each of the retention slots 200, 205, and 210 may be shaped and sized to receive and hold the legs 175, 180, 190, respectively.

Figure 4:
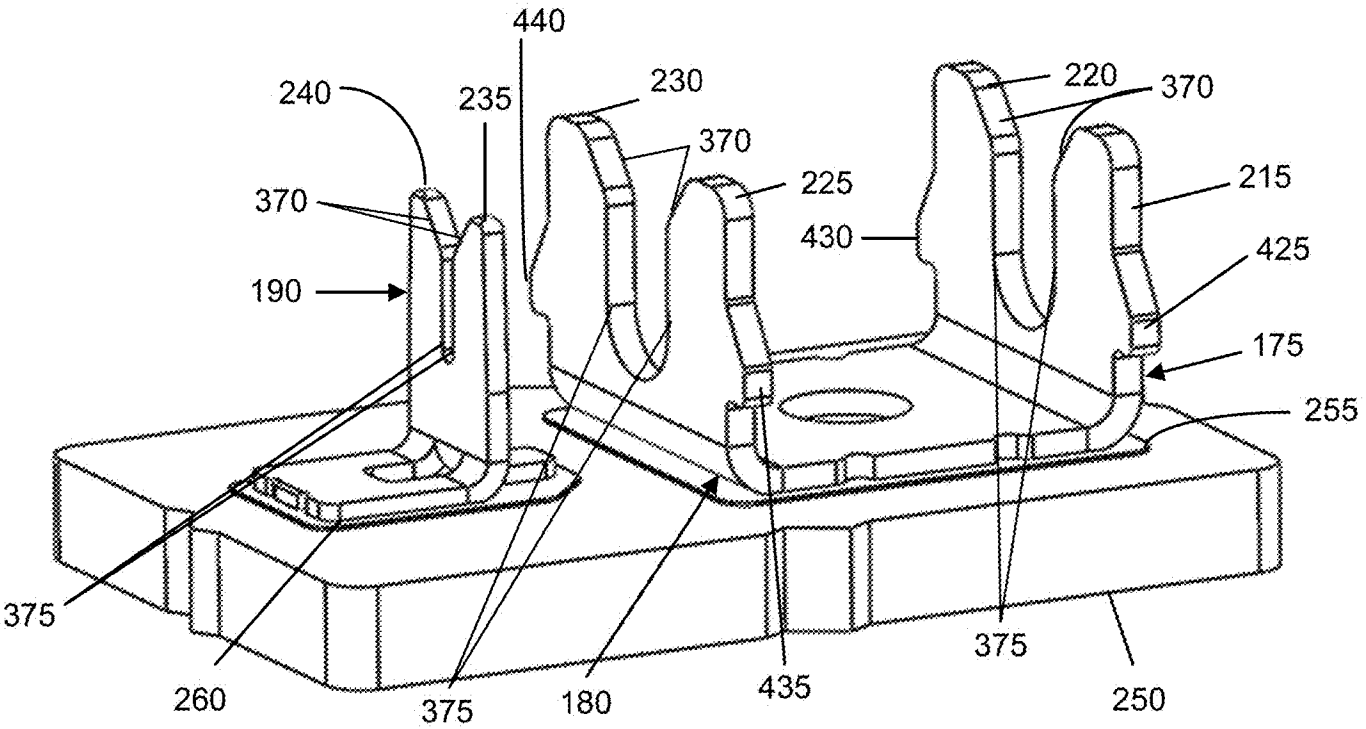
FIG. 4 shows the first and second DC connected to the electrical component and with the carrier disengaged from the first and second DC, in accordance with an illustrative embodiment.
Figure 5:
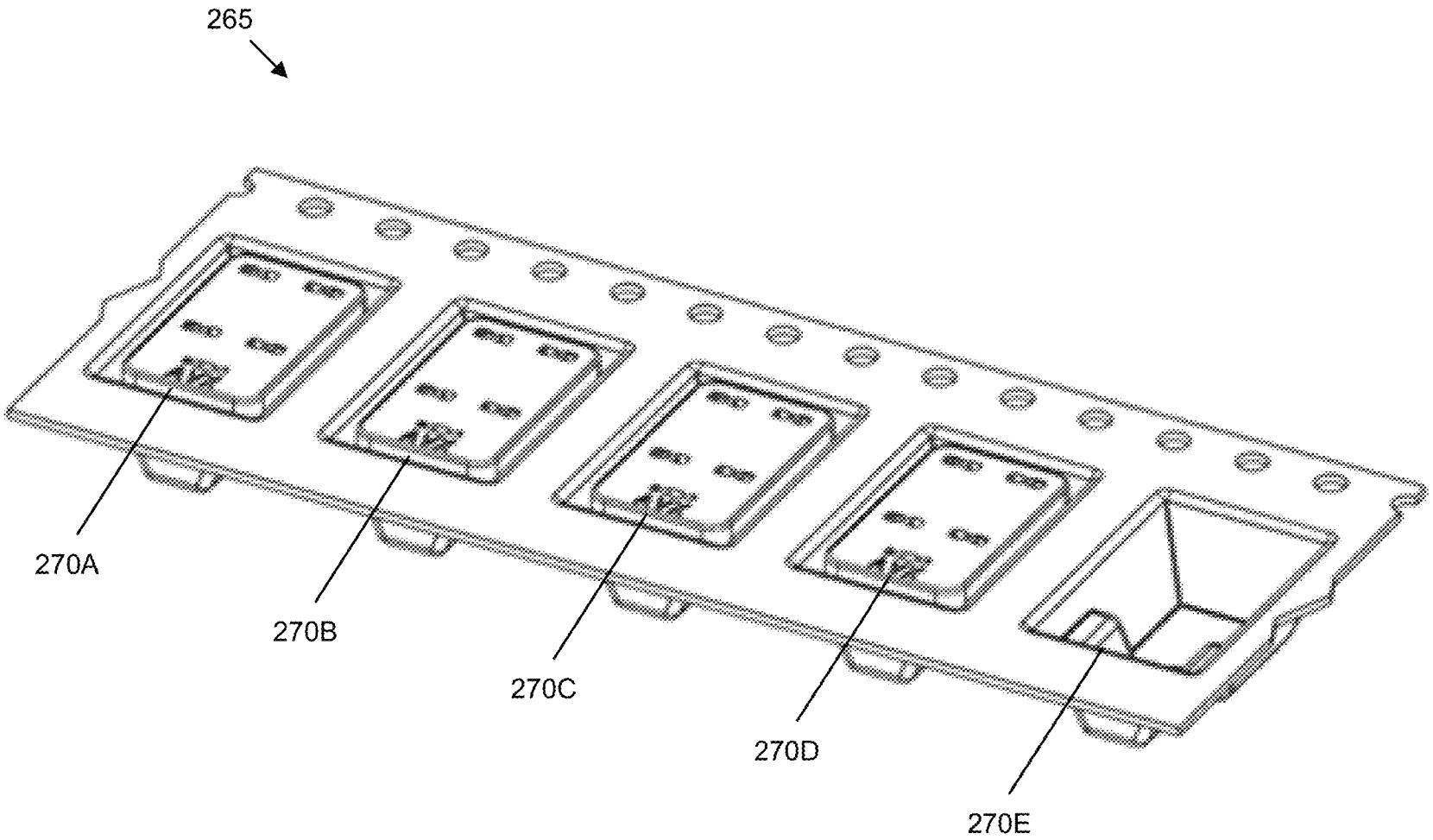
FIG. 5 shows a pocket tape with singulated carriers loaded into individual pockets for delivery, in accordance with an illustrative embodiment.

As seen in FIG. 4, each of the legs 175, 180, and 190 has a pair of prongs. For example, the leg 175 may have prongs 215, 220, the leg 180 may have prongs 225, 230, and the leg 190 may have prongs 235, 240. In some embodiments, the tips of each of those prongs may be configured to be engaged within the retention slots 130. Thus, each of the retention slots 130 may be shaped and sized to accommodate the tips of the prongs 215-240 securely (but not too tightly to prevent disengagement). Specifically, and as shown in FIG. 2, each of the retention slots 130 may include one or more retention ribs 245 that may be configured to secure a respective pair of the prongs 215-240 within the retention slots 130. For example, in some embodiments, to retain or secure the prongs 215-240 within the retention slots 130, those prongs may be inserted (e.g., friction fitted) within the appropriate retention slots. Upon insertion, the shape and configuration of the retention ribs 245 may prevent the respective prong from being dislodged unintentionally from the retention slots 130. In other embodiments, one or more of the retention slots 130 may assume other configurations to engage the prongs 215-240. By virtue of engaging the prongs 215-240 within the retention slots 130, the carrier 105 may engage the ground contact 165 and the signal contact 170 for picking and positioning/orienting the ground contact and the signal contact on the electrical component on which those contacts have to be assembled. Further, by virtue of appropriately spacing the legs 140 and 145, the carrier may achieve a consistent and desired spacing between the ground contact 165 and the signal contact 170. Upon engaging the prongs 215-240 within the retention slots 130, the legs 135 and 140 of the carrier 105 rest on the floor 185 of the ground contact 165 and the leg 145 of the carrier rests on the floor 195 of the signal contact 170.

Figure 3:
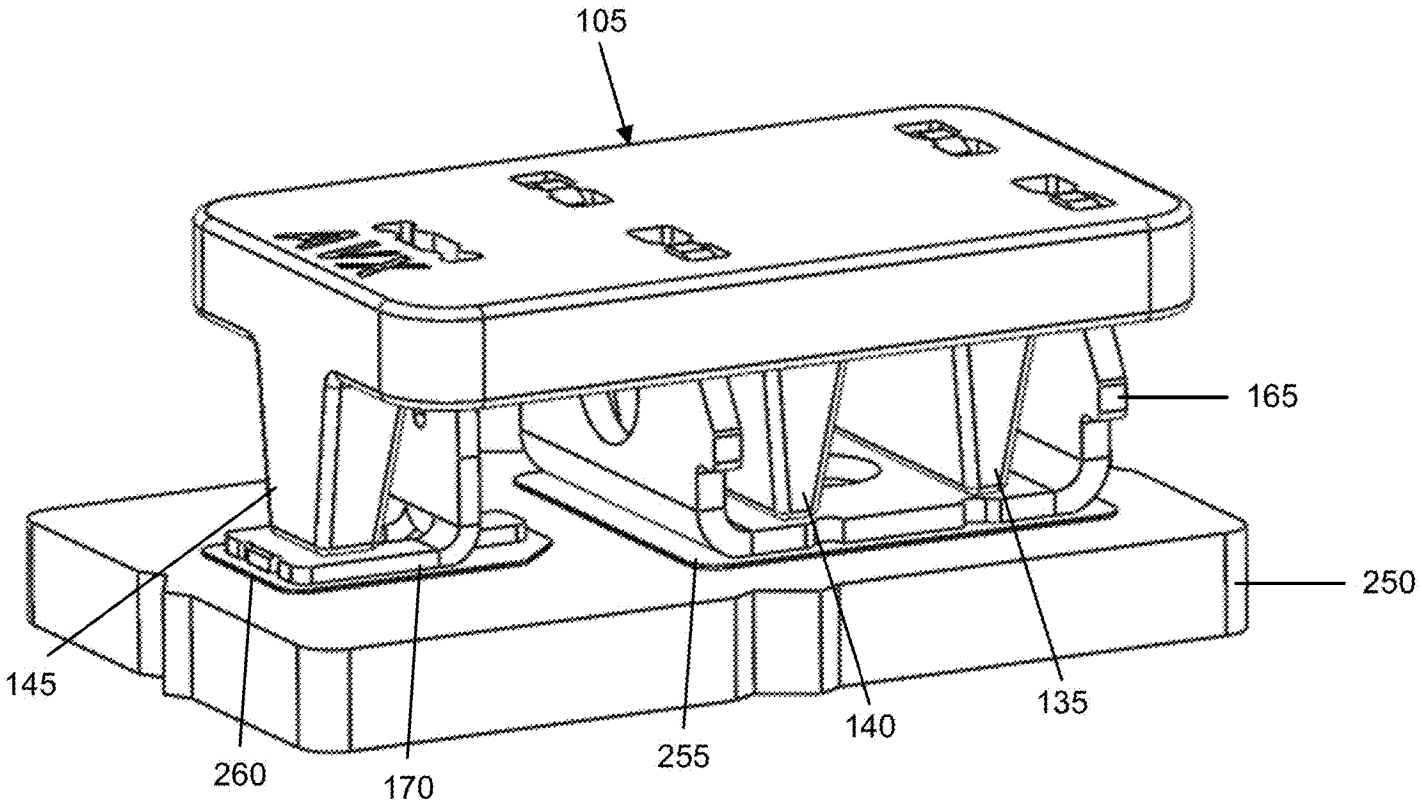
FIG. 3 shows the carrier and the first and second IDC positioned on the electrical component for electrical connection between the first and second DC and the electrical component, in accordance with an illustrative embodiment.

Turning now to FIG. 3, an example of assembling the ground contact 165 and the signal contact 170 on an electrical component 250 is shown, in accordance with some embodiments of the present disclosure. In some embodiments, the electrical component 250 may be a printed circuit board. In other embodiments, the electrical component 250 may be another type of electrical device on which the ground contact 165 and the signal contact 170 are to be assembled. To install the ground contact 165 and the signal contact 170 on the electrical component 250, the ground contact and the signal contact may be engaged with the carrier 105 by securing (e.g., inserting) the prongs 215-240 in a respective one of the retention slots 130. Upon engaging the prongs 215-240 of the ground contact 165 and the signal contact 170 with the carrier 105, the carrier may position the floor 185 of the ground contact 165 for assembly (e.g., soldering) on the electrical component 250 such that the ground contact is assembled to a first contact pad 255. The carrier 105 may also position the floor 195 of the signal contact 170 for assembling the signal contact to a second contact pad 260.

Upon assembling (e.g., soldering) the floor 185 of the ground contact 165 to the first contact pad 255 and the floor 195 of the signal contact 170 to the second contact pad 260, the carrier 105 may be disengaged from the ground contact and the signal contact.

In some embodiments, the carrier 105 may be disengaged from the ground contact 165 and the signal contact 170 by disengaging the prongs 215-240 from the respective retention slots 130 in which those prongs were engaged. In some embodiments, the disengagement of the prongs 215-240 from the respective ones of the retention slots 130 may occur via gently pulling the base 115 of the carrier 105 in a direction away from the electrical component 250. In some embodiments, tools such as pliers, levers, prongs, crowbars, etc. may be used to remove the carrier 105 from the ground contact 165 and the signal contact 170. Upon removing the carrier 105, the ground contact 165 and the signal contact 170 remain secured to the electrical component 250, as shown in FIG. 4, and ready to accept a cable for providing an electrical connection between the cable and the electrical component 250. An example configuration of a cable is shown in FIG. 6 below.

Referring now to 5, a portion of a pocket tape 265 is shown, in accordance with some embodiments of the present disclosure. The pocket tape 265 may be an embossed carrier tape and may be made from a continuous strip of relatively thin plastic film. This strip of plastic film may be fed through a machine, which may heat the plastic film such that smaller sections may be vacuumed and/or blown into precise cavities in the processing line. The cavities may be regularly spaced pockets 270A-270E in the continuous strip of plastic film. Even though the pocket tape 265 is shown as having five pockets (e.g., the pockets 270A-270E), in other embodiments, the pocket tape may be configured as a continuous strip having any number of pockets therein. Each of the pockets 270A-270E may be specifically designed and produced for the component they are intended to carry to provide precise positioning and ability to be picked up by a robot and placed onto the electrical component 250. In some embodiments, each of the pockets 270A-270E may be configured to carry the carrier 105, which may be picked up (e.g., by a robot) and secured to the ground contact 165 and the signal contact 170 before placing on the electrical component 250. In other embodiments, each of the pockets 270A-270E may be configured to carry the carrier system 100 (e.g., including the carrier 105 and the electrical contacts 110 secured therein).

In some embodiments, one instance of the carrier 105 or the carrier system 100 may be placed in each of the pockets 270A-270E. In some embodiments, upon placing the carrier 105 or the carrier system 100 into the pockets 270A-270E, a thin, transparent cover tape may be bonded to the pocket tape to prevent the components in the pockets from coming out. The pocket tape 265 does not show this cover tape. The filled pocket tape (e.g., the pocket tape 265 covered by the cover tape) may then be wrapped onto a pick-up reel for compact packaging for delivery. The cover tape may be peeled away to allow access to the components in the pockets 270A-270E. For example, in some embodiments, the top surface 120 of the base 115 of the carrier 105 positioned within one of the pockets 270A-270E may be contacted by a vacuum head of a robot to pick up the carrier in that pocket. In some embodiments, industry standards for the pocket tape packaging may dictate that a length of the pocket tape at the beginning and end of the pick-up reel be left empty. For example, the pocket 270E is shown empty with no component therein. Thus, the carrier 105 or the carrier system 100 may be conveniently packaged in a segment of continuous pocket tape (e.g., the pocket tape 265) for delivery to the end user.

Figure 6:
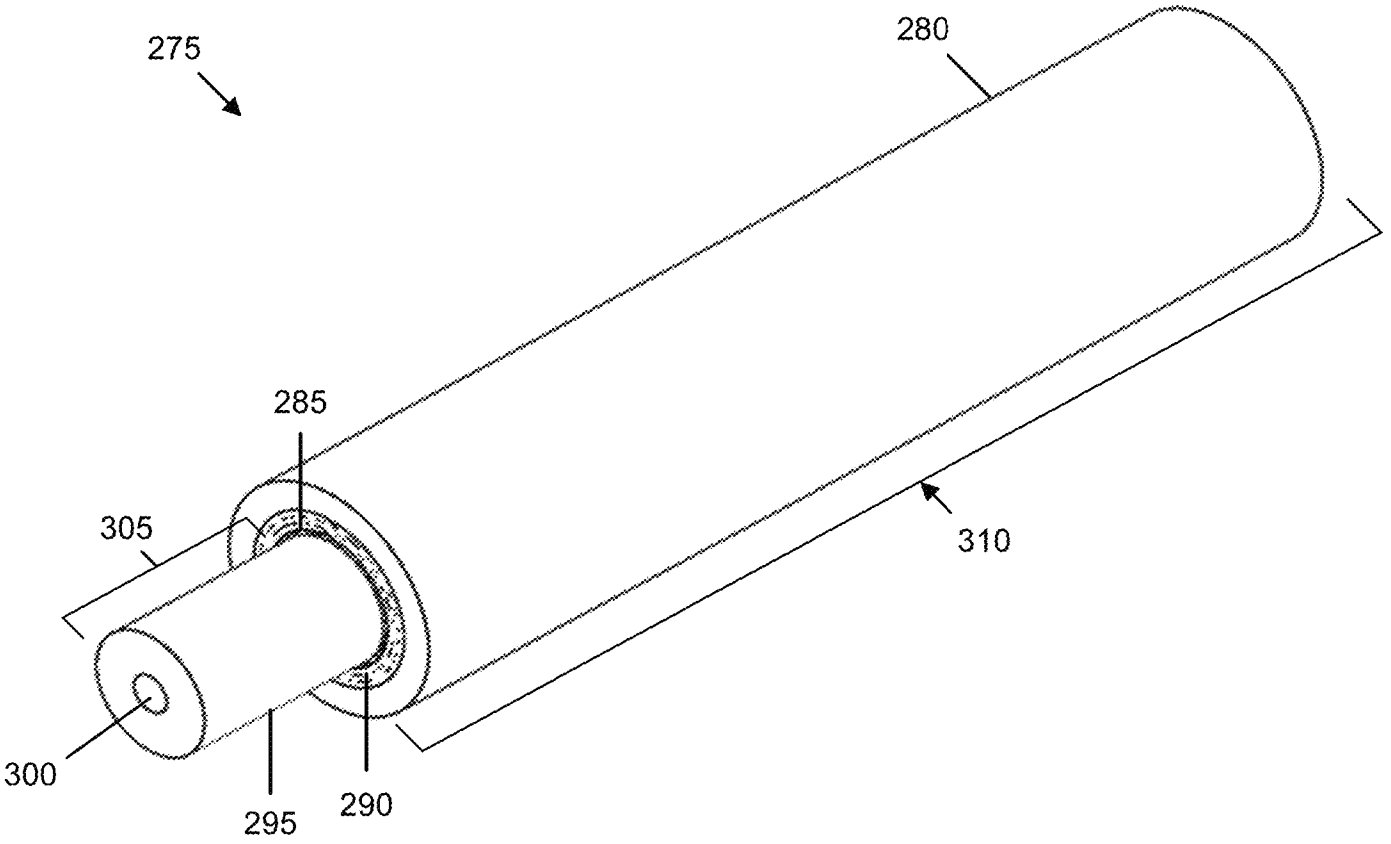
FIG. 6 shows an example of a coaxial cable, in accordance with an illustrative embodiment.

Turning to FIG. 6, an example of a coaxial cable 275 is shown, in accordance with some embodiments of the present disclosure. In some embodiments, the coaxial cable 275 may include an outer insulated jacket 280, a foil shield 285, a braided wire shield 290, a dielectric 295, and a signal conductor 300. An exposed portion 305 of the coaxial cable 275 is shown with the outer insulated jacket 280, the foil shield 285, and the braided wire shield 290 removed to expose the dielectric 295 and the signal conductor 300. The exposed portion 305 of the coaxial cable 275 may be received between the prongs 235 and 240 of the signal contact 170, while a non-exposed portion 310 may be received between the prongs 215-230 of the ground contact 165. In some embodiments, the length of the exposed portion 305 may be such that the dielectric 295 of the exposed portion does not make contact with the prongs 215-230 of the ground contact 165. Thus, the length of the exposed portion 305 may correspond somewhat to the spacing between the prongs 235/240 of the signal contact 170 and the prongs 225/230 of the ground contact 165. In other embodiments, the coaxial cable 275 may have a varying configuration than that shown. Further, although the coaxial cable 275 has been shown herein, in other embodiments, the present disclosure may be used with any type of cable or wire that is to be electrically connected with the electrical component 250.

Figure 7:
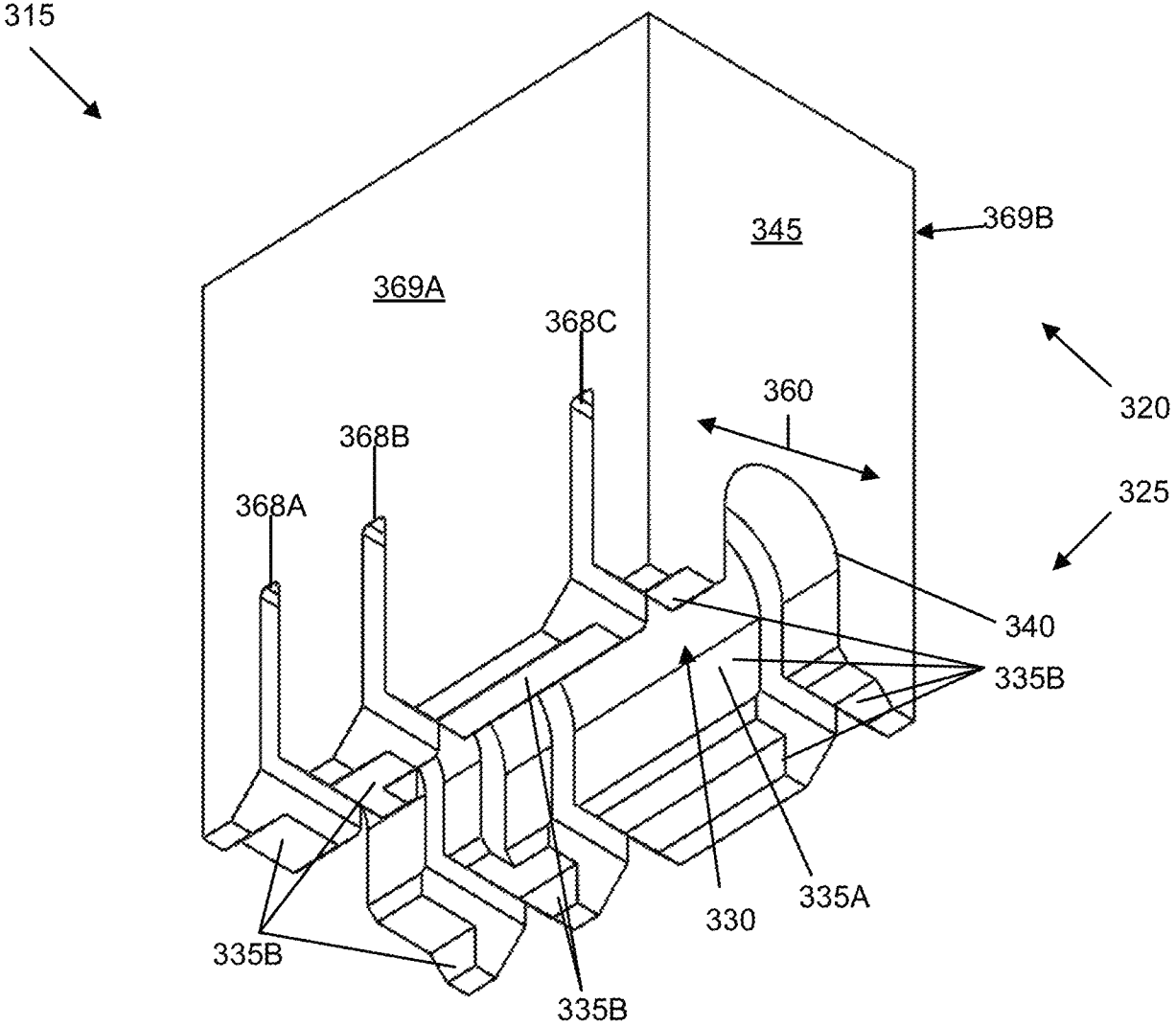
FIG. 7 shows an example of a seating tool for securing the coaxial cable of FIG. 6 therein for inserting the coaxial cable between the first and second IDC, in accordance with an illustrative embodiment.

Referring to FIG. 7, an example of a seating tool 315 is shown, in accordance with some embodiments of the present disclosure. The seating tool 315 may be used to axially position the coaxial cable 275 over and into the ground contact 165 and the signal contact 170. Specifically, in some embodiments, the coaxial cable 275 may be engaged within the seating tool 315 and seating tool having the coaxial cable engaged therein may be positioned over the prongs 215-240 to insert the coaxial cable through the prongs. Upon positioning/inserting the coaxial cable 275 within the prongs 215-240, the ground contact 165 provides two points of contact (with each prong pair providing one point of contact) between the coaxial cable and the electrical component 250, while the signal contact 170 provides a single point of contact between the coaxial cable and the electrical component. In some embodiments, upon inserting the coaxial cable 275 within the prongs 215-240, the ground contact 165 connects the shielding portion(s) (e.g., one or more of the outer insulated jacket 280, the foil shield 285, the braided wire shield 290, the dielectric 295) of the coaxial cable 275 to the electrical component 250, while the signal contact 170 connects the signal conductor 300 of the coaxial cable to the electrical component.

In some embodiments, the seating tool 315 may be composed of plastic or metal. In other embodiments, the seating tool 315 may be composed of other non-conductive materials, other conductive materials, or other suitable materials. The seating tool 315 may include a top portion 320 and a bottom portion 325. The top portion 320 may be used for gripping the seating tool while positioning the coaxial cable 275 therein, and upon engaging the coaxial cable within the seating tool, for positioning the coaxial cable over the ground contact 165 and the signal contact 170. Although the top portion 320 is shown to have a rectangular configuration, in other embodiments, the top portion may assume other shapes and sizes. The bottom portion 325 may be configured for receiving the coaxial cable 275 therein and for transferring the coaxial cable from the seating tool to the ground contact 165 and the signal contact 170.

In some embodiments, the bottom portion 325 may include a cavity 330 having a curved inner wall 335A. The inner wall 335A may define one or more surfaces (e.g., ribbed surfaces) 335B that may enable the coaxial cable to transfer from the seating tool 315 to the ground contact 165 and the signal contact 170 when downward force is applied to the seating tool. The cavity 330 and the inner wall 335A may define a first opening 340 on a first side wall 345 of the seating tool and a second opening 350 (see FIG. 8) on a second side wall 355 (see FIG. 8) of the seating tool. In some embodiments, the cavity 330, the inner wall 335A, the first opening 340, and the second opening 350 may each be semicircular or substantially semicircular in shape to receive the cylindrical coaxial cable therein. Further, in some embodiments, a width 360 of the first opening 340 may be greater than a width 365 (see FIG. 8) of the second opening 350. The width 360 of the first opening 340 may be configured to accommodate the non-exposed portion 310 of the coaxial cable 275, while the width 365 of the second opening 350 may be configured to accommodate the exposed portion 305 of the coaxial cable. Further, the cavity 330 may be sized to secure the coaxial cable 275 in place within the seating tool 315 for engagement with the ground contact 165 and the signal contact 170 without unintentional disengagement from the seating tool.

To position the coaxial cable 275 within the cavity 330, in some embodiments, the end of the coaxial cable at the exposed portion 305 may be pushed into the cavity either through the first opening 340 or through the open end of the cavity such that the end of the exposed portion rests adjacent to the second opening 350. In some embodiments, the second opening 350 may be sized such that the end of the exposed portion 305 may not be able to come out of the second opening 350 when the coaxial cable is inserted into the cavity 330. Thus, in some embodiments, the second opening 350 may serve as a stopping point for the coaxial cable (e.g., when the coaxial cable cannot be pushed further into the cavity with reasonable force, the coaxial cable may be considered positioned within the cavity). Upon inserting the coaxial cable 275 into the seating tool 315, the seating tool may be positioned over the ground contact 165 and the signal contact 170 to insert the coaxial cable between the prongs 215-240 thereof, as shown in FIG. 8.

Figure 8:
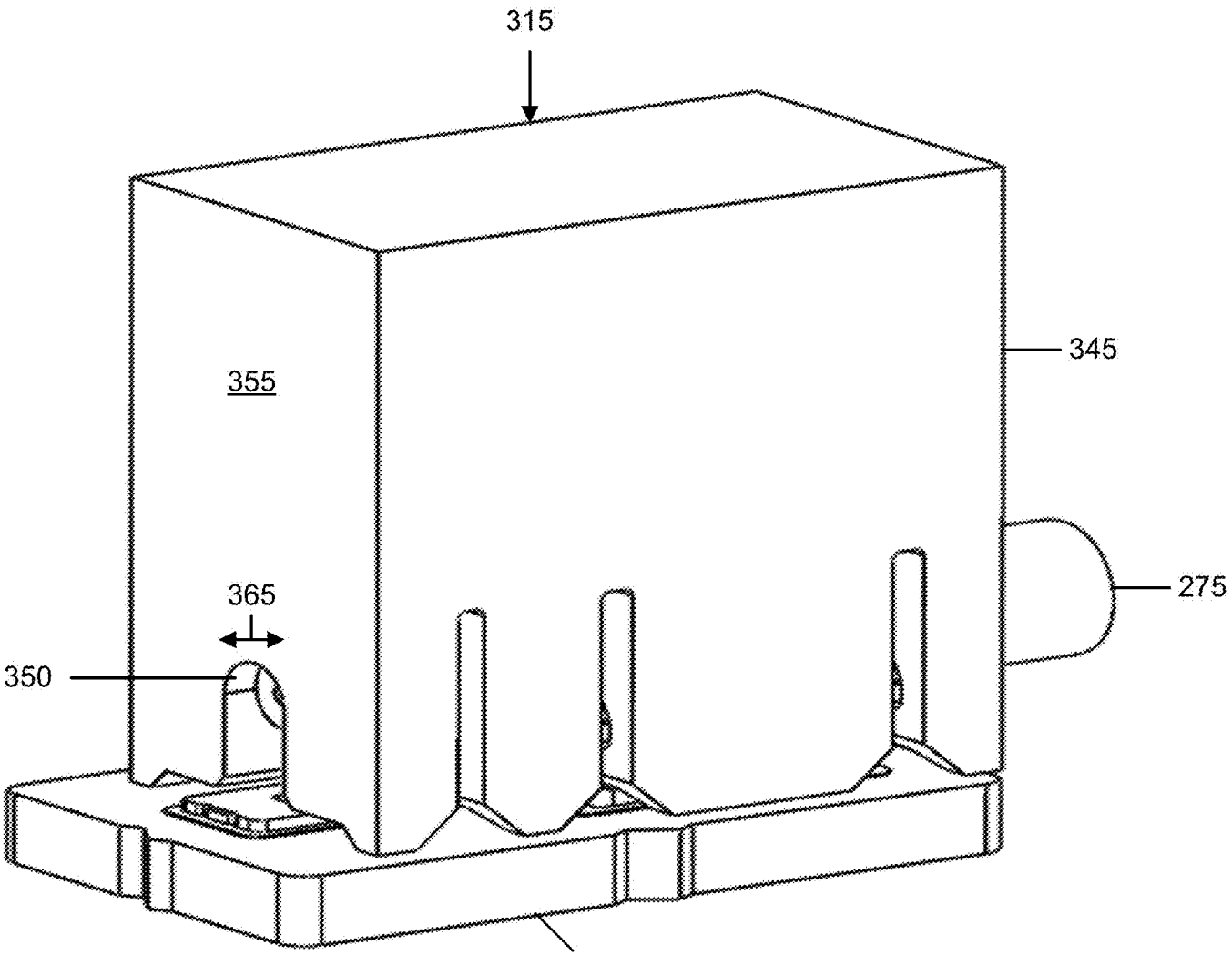
FIG. 8 shows the seating tool of FIG. 7 having the coaxial cable secured therein positioned over the first and second IDC for transferring the coaxial cable from the seating tool to the first and second IDC, in accordance with an illustrative embodiment.

Specifically, and as shown in FIG. 8, in some embodiments, the seating tool 315 may be positioned over the ground contact 165 and the signal contact 170 such that the second opening 350 of the seating tool is adjacent to the signal contact and the first opening 340 is adjacent to the ground contact. Since the exposed portion 305 of the coaxial cable 275 is secured closer to the second opening 350 within the cavity 330 of the seating tool and since the exposed portion is intended to be inserted between the prongs 235 and 240 of the signal contact 170, by positioning the seating tool such that the second opening is closer to the signal contact, the exposed portion of the coaxial cable may be inserted between the prongs of the signal contact. Similarly, since the non-exposed portion 310 of the coaxial cable 275 is secured closer to the first opening 340 of the seating tool 315, and since the non-exposed portion is intended to be inserted between the prongs 215-230 of the ground contact, by positioning the seating tool such that the first opening is closer to the ground contact, the non-exposed portion may be inserted between the prongs of the ground contact. Further, the seating tool 315 may include a plurality of slots, such as slots 368A, 368B, and 368C that may be configured to receive the prongs 215-240 and allow the seating tool with the coaxial cable 275 inserted therein to be pushed down towards the electrical component 250 without being impeded by those prongs. In some embodiments, each of the slots 368A-368C may extend in the direction of the width 360 from a first wall 369A of the seating tool to a second wall 369B that is opposite of the first wall. The thickness and positioning of each of the slots 368A-368C may correspond to the thickness and positioning of the prongs 215-240 that each of those slots is designed to receive.

Figure 9:
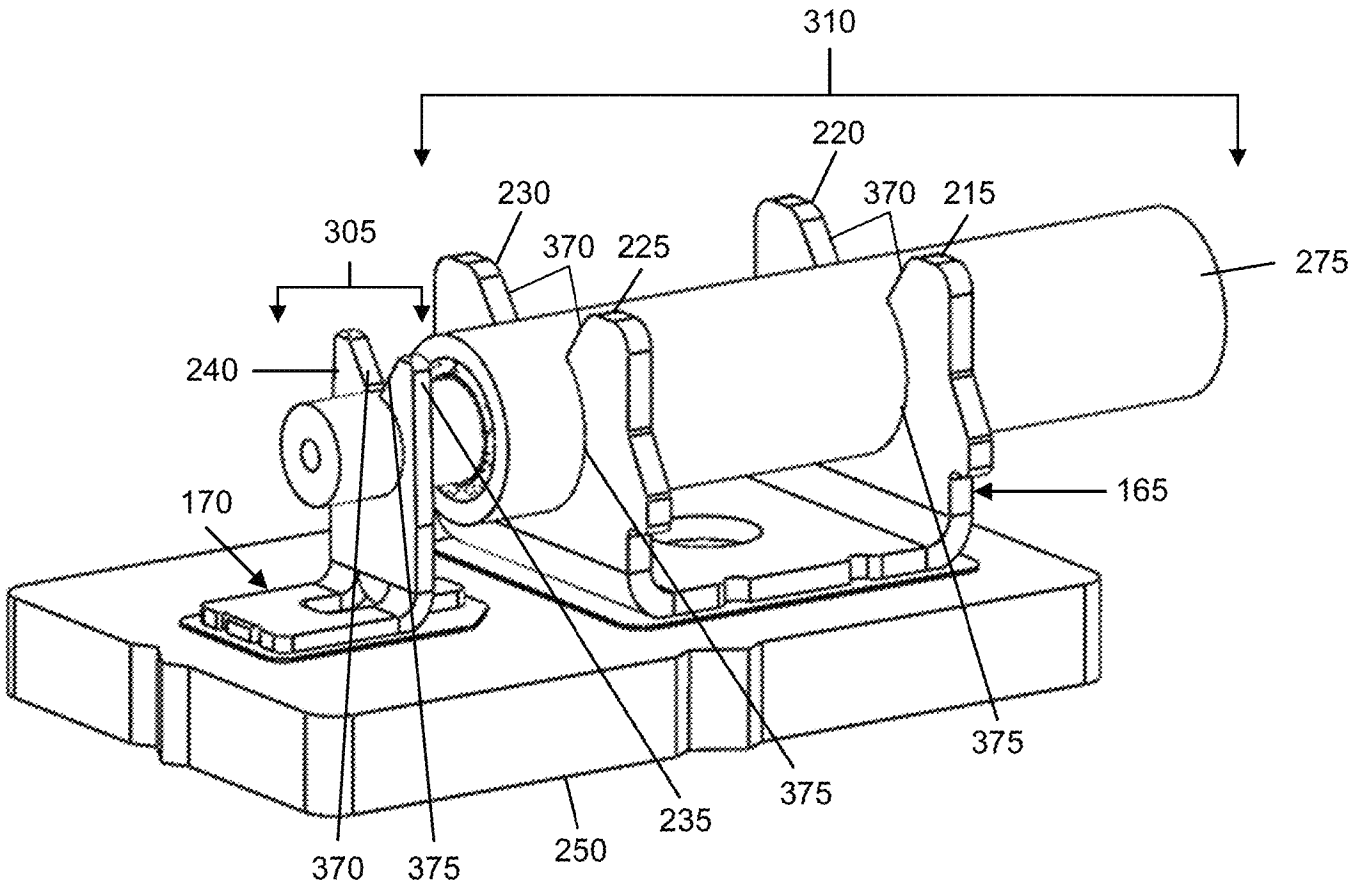
FIG. 9 shows the first and second IDC with the coaxial cable connected thereto and with the seating tool removed, in accordance with an illustrative embodiment.

To transfer the coaxial cable 275 from the seating tool 315 to the ground contact 165 and the signal contact 170, the seating tool may be positioned over those contacts, as discussed above, and pushed down gently towards the electrical component 250. The downward force of the seating tool 315 towards the electrical component 250 may cause the surfaces 335B of the seating tool to abut one or more surfaces of the ground contact 165 and the signal contact 170, and restrict the motion of the seating tool towards the electrical component, causing the coaxial cable 275 to be disengaged from the cavity 330 of the seating tool and inserted between the prongs 215-240 of the ground contact and the signal contact. Upon transferring the coaxial cable 275 from the seating tool 315 to the ground contact 165 and the signal contact 170, the seating tool may be removed (e.g., pulled away). The coaxial cable 275 inserted between the ground contact 165 and the signal contact 170 with the seating tool 315 removed is shown in FIG. 9.

In some embodiments, the seating tool 315, and particularly the size of the cavity 330, may be sized based upon the distance between the prongs 235/240 of the signal contact 170 and the prongs 225/230 of the ground contact 165. Specifically, the seating tool 315, and particularly the size of the cavity 330, may be sized such that when the seating tool is positioned over the ground contact 165 and the signal contact 170, the exposed portion 305 of the coaxial cable 275 does not come into contact with the prongs 225/230 of the ground contact. By virtue of the sizing and shape configuration of the cavity 330 of the seating tool 315, the seating tool enables a proper positioning and orientation of the coaxial cable 275 over the ground contact 165 and the signal contact 170 without needing to handle (e.g., touch) the coaxial cable. Thus, the seating tool 315 enables proper vertical and axial positioning of the coaxial cable 275 with respect to the ground contact 165 and the signal contact 170.

The prongs 215-240 are shaped and sized to receive and hold the coaxial cable 275 in place. In some embodiments, each pair of the prongs 215-240 may be biased towards each other. The spacing between the corresponding pairs of biased prongs may be based upon the diameter or circumference of the coaxial cable that those pairs of prongs are designed to receive. For example, the exposed portion 305 of the coaxial cable 275 has a smaller diameter (e.g., due to stripping away of some layers of the coaxial cable) than the non-exposed portion 310 of the coaxial cable. Thus, to accommodate the smaller diameter of the exposed portion 305, as seen more clearly in FIG. 4, the prongs 235/240 of the signal contact 170 have a smaller spacing therebetween than the prongs 215-230 that receive the non-exposed portion 310. Further, in some embodiments, each of the prongs 215-240 may have a sharper edge 370 that cuts through the surface of the coaxial cable 275 as the coaxial cable is being inserted through those prongs from the seating tool 315. In some embodiments, the edge 370 may have a specific configuration (e.g., slope and angle) to facilitate the desired depth of the cut with minimum pressure. The edge 370 of each of the prongs 215-240 may lead to a curved surface 375 that is designed to seat the coaxial cable 275 and accommodate the curvature of the coaxial cable. Each pair of corresponding prongs 215-240 may form a substantially U-shaped configuration. The shape and configuration of the prongs 215-240 is visible more clearly in FIG. 4. When the coaxial cable 275 is inserted between the prongs 215-240, the edge 370 of the signal contact 170 may cut through the dielectric 295 such that when the coaxial cable rests in contact with the curved surface 375, the curved surface of the prongs make contact with the signal conductor 300. Similarly, when the coaxial cable 275 is inserted between the prongs 215-240, the edge 370 of the ground contact 165 may cut through one or more desired layers of the coaxial cable such that when the coaxial cable rests in contact with the curved surface 375, the curved surface of the prongs 215-230 make contact with the appropriate surface (e.g., with the foil shield 285 and the braided wire shield 290).

Figure 10:
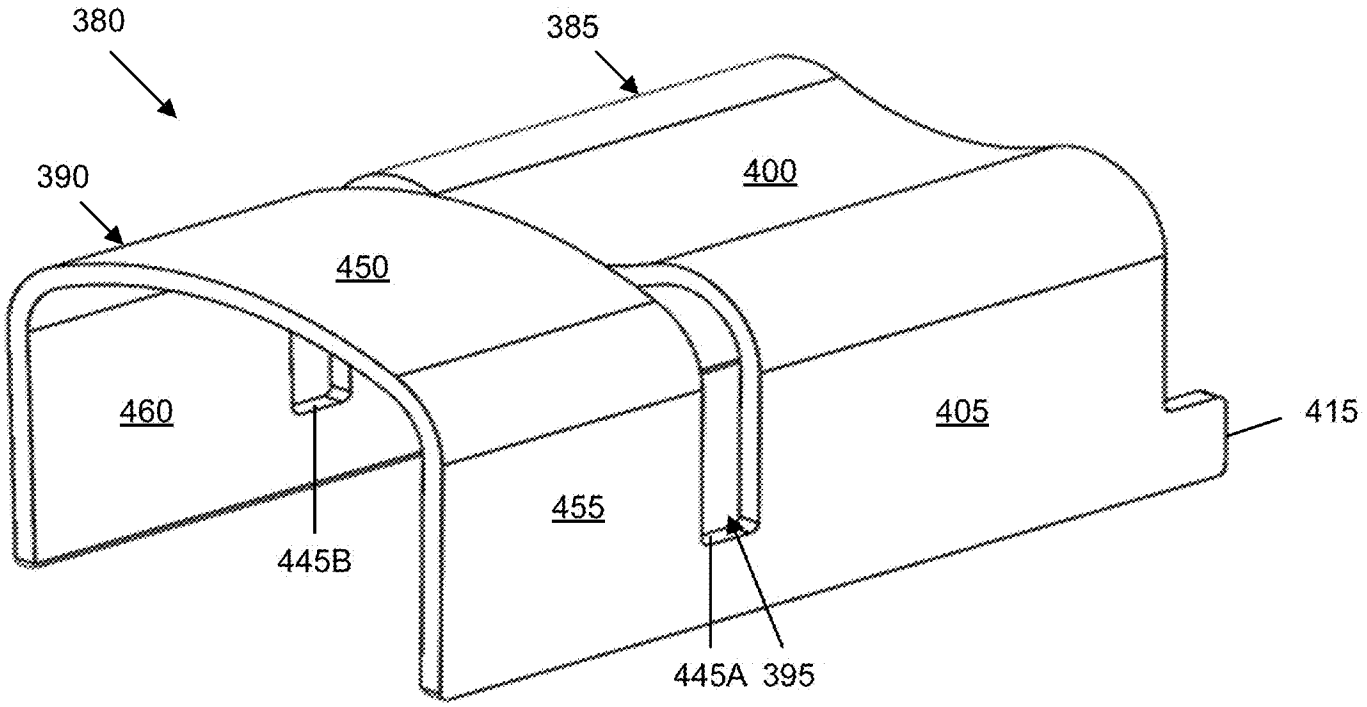
FIG. 10 shows an example of a cover configured to be assembled over the first and second IDC, in accordance with an illustrative embodiment.

Upon inserting the coaxial cable 275 within the ground contact 165 and the signal contact 170, as discussed above, the ground contact 165 provides two points of contact (one point of contact with each pair of prongs 215/220, 225/230) with the coaxial cable to increase mechanical stability and provide better electrical connection between the coaxial cable and the electrical component 250. In some embodiments, extra shielding (e.g., in a low frequency application) or mechanical strain relief may not be required or desired (e.g., if the assembly of the electrical contacts 110 and the coaxial cable 275 is to be potted in a resin). In such embodiments, a cover may not be needed. In other embodiments, a cover may be provided over the ground contact and the signal contact to provide mechanical stability and strain relief, as well as extra shielding. An example configuration of such a cover 380 is shown in FIG. 10, in accordance with some embodiments of the present disclosure. The assembly of the cover 380 over the ground contact 165 and the signal contact 170 is shown in FIGS. 11A-11C.

Figure 11A:
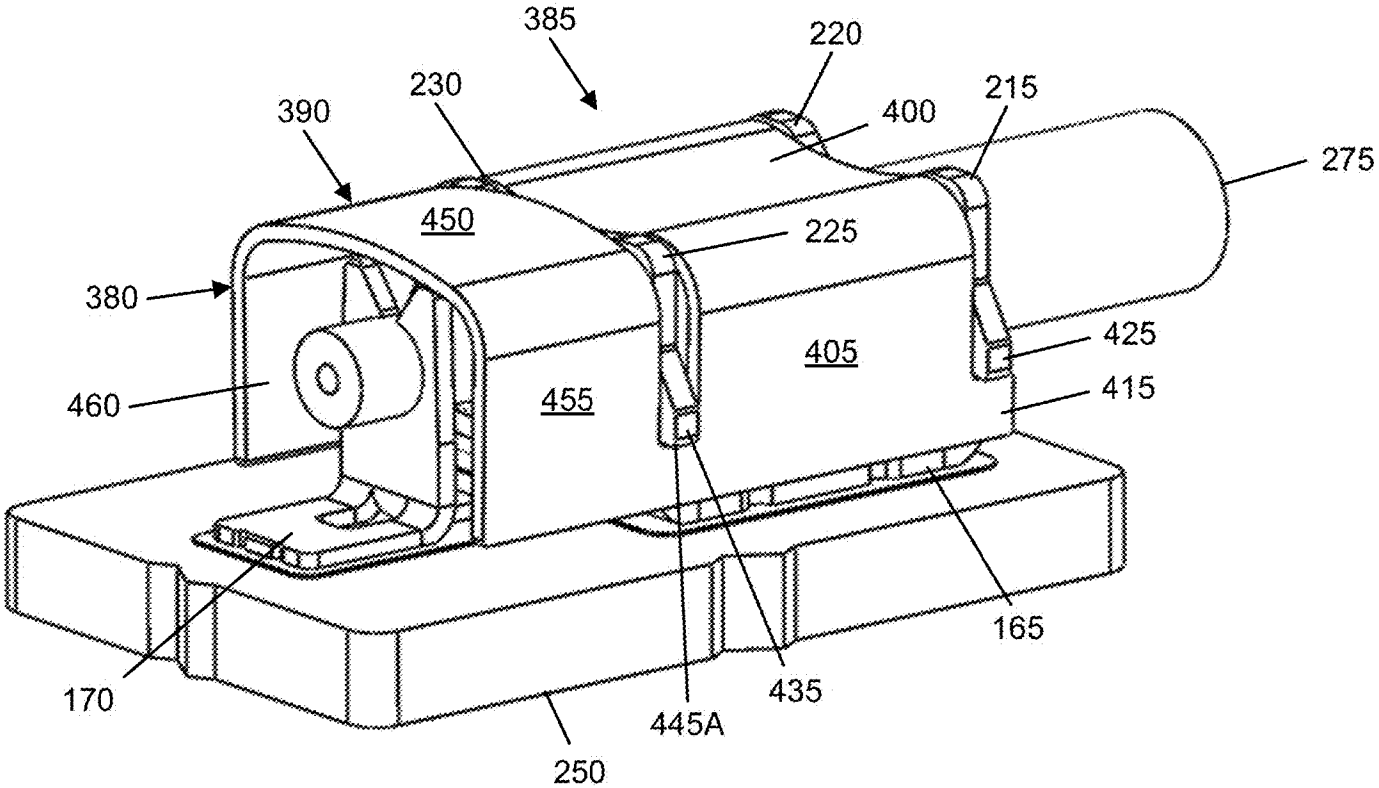
FIGS. 11A-11C show various views of the cover assembled over the first and second IDC, in accordance with an illustrative embodiment.
Figure 11B:
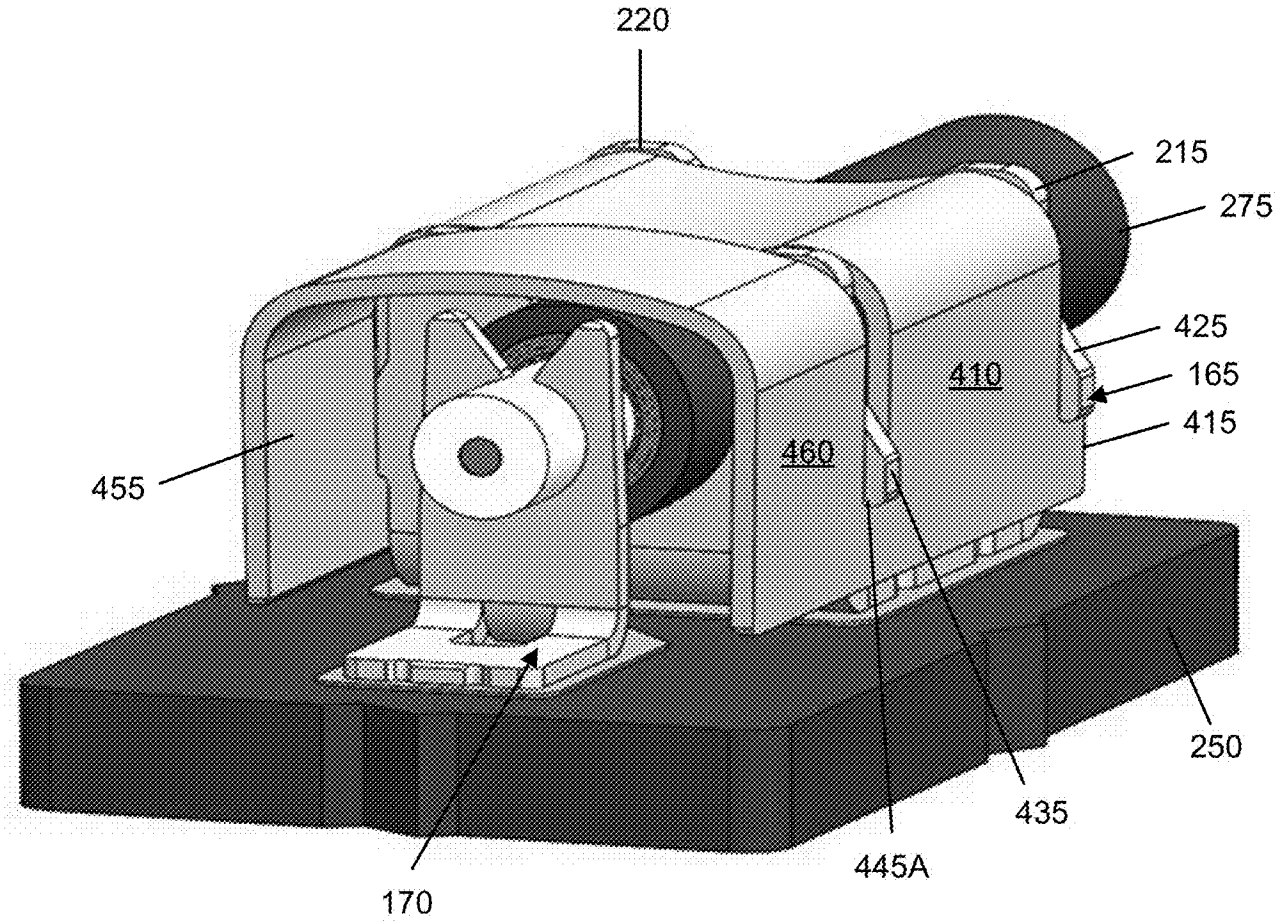
Figure 11C:
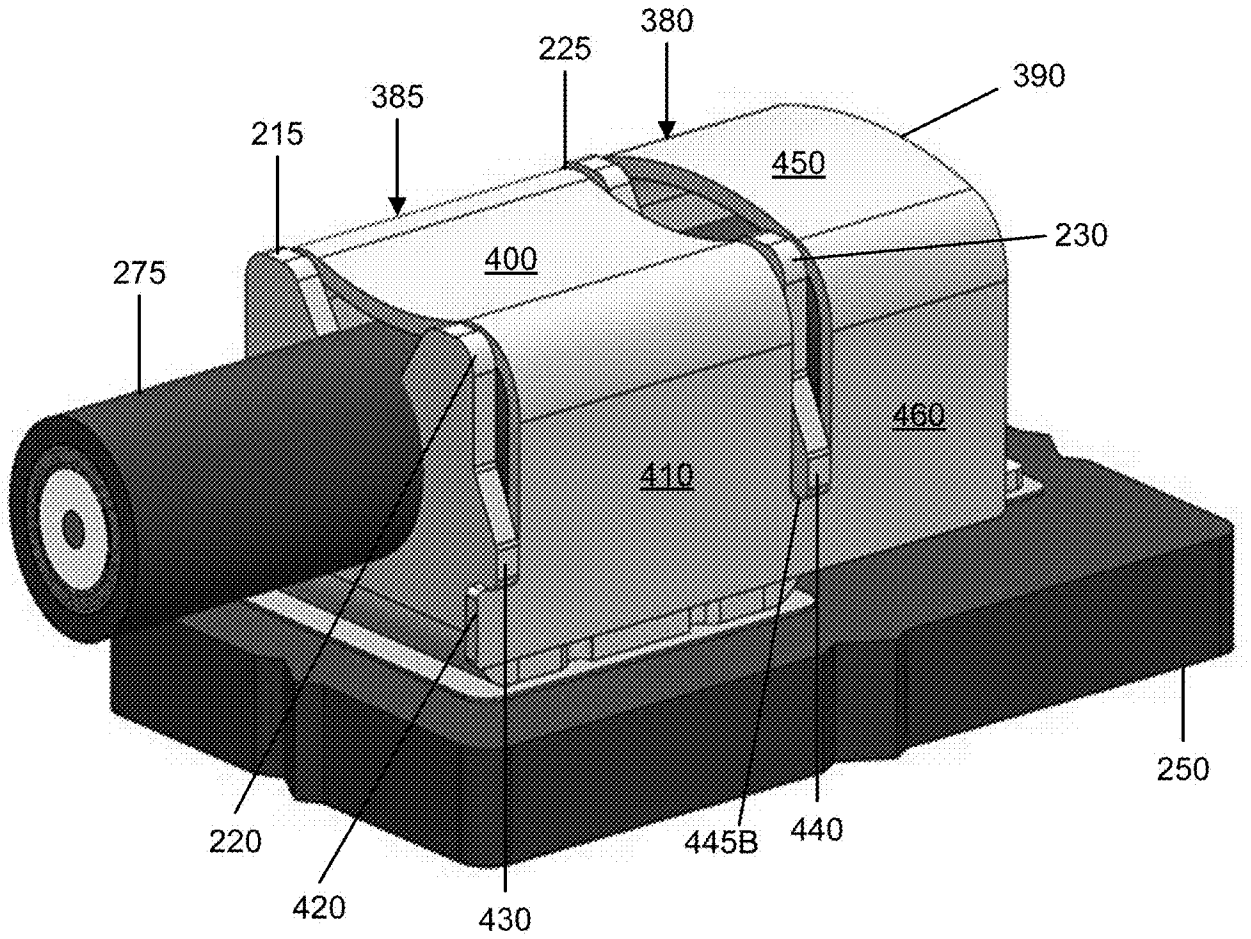

Referring to FIGS. 10-11C, the cover 380 includes a first portion 385 and a second portion 390. Upon assembly, the first portion 385 may cover the ground contact 165 and the second portion 390 may cover the signal contact 170. In some embodiments, the first portion 385 and the second portion 390 may be separated by a retention gap 395. The retention gap 395 may be configured to accommodate the prongs 225 and 230 of the ground contact 165, as shown in FIGS. 11A-11C. In some embodiments, the cover 380 may be composed of a metal or other conductive material.

Further, each of the first portion 385 and the second portion 390 may have a somewhat C-shaped configuration. For example, the first portion 385 may include a top wall 400, a first side wall 405, and a second side wall 410. The top wall 400, the first side wall 405, and the second side wall 410 may be configured to provide mechanical stability to the ground contact 165 upon assembly of the cover 380. In some embodiments, the top wall 400 of the first portion 385 may be bowed or bent inwards towards the prongs 215-230 to have a substantially concave top surface. Further, in some embodiments, the first side wall 405 and the second side wall 410 may be biased towards each other to provide a snug fit over the ground contact 165. The bowed surface of the top wall 400 may be configured to touch the coaxial cable 275, and particularly the non-exposed portion 310 of the coaxial cable, upon assembly over the ground contact 165. By making contact with the coaxial cable 275, the first portion 385 compresses the coaxial cable 275, and particularly the non-exposed portion 310, to provide support to the coaxial cable over the ground contact and maintain the electrical connection between the non-exposed portion and the electrical component 250.

Further, in some embodiments, each of the first side wall 405 and the second side wall 410 may have a ledge 415 and 420, respectively, extending therefrom and away from (e.g., opposite) the retention gap 395. The ledge 415 may be configured to engage with a flange 425 of the prong 215 of the ground contact 165. The ledge 420 may be configured to engage with a flange 430 of the prong 220 of the ground contact 165. As seen more clearly in FIG. 4, each of the prongs 215 and 220 has the flanges 425 and 430, respectively, extending outwardly therefrom. The flanges 425 and 430 may be configured to engage the cover 380. Specifically, when the cover 380 is positioned over the ground contact 165 and the signal contact 170, a bottom surface of the flange 425 rests on the ledge 415 and a bottom surface of the flange 430 rests on the ledge 420. By resting on the flanges 425 and 430, the ledges 415 and 420 make contact with portions of the prongs 215 and 220 and forms an electrical connection between at least the first portion 385 of the cover 380 and the ground contact 165.

Similar to the flanges 425 and 430, the prongs 225 and 230 have flanges 435 and 440, respectively. The flange 435 is configured to rest on a first engagement surface 445A formed in the retention gap 395 in the area where the first portion 385 connects with the second portion 390. The flange 440 is configured to rest on a second engagement surface 445B formed in the retention gap 395 in the area where the first portion 385 connects with the second portion 390. Also similar to the ledges 415 and 420, the contact between the surface 445 and the flanges 435 and 440 forms an electrical connection between the ground contact 165 and at least the first portion 385 of the cover 380.

Thus, the cover 380 includes the first portion 385 over the ground contact 165 (e.g., the first insulation displacement contact) and the second portion 390 over the signal contact 170 (e.g., the second insulation displacement contact). The cover 380 further includes the retention gap 395 between the first portion 385 and the second portion 390 to engage the cover with a first pair of prongs (e.g., the prongs 225, 230) of the first insulation displacement contact (e.g., the ground contact 165). The first portion 385 of the cover 380 includes the first ledge 415 and the second ledge 420 configured to engage the cover with a second pair of prongs (e.g., the prongs 215, 220) of the first insulation displacement contact (e.g., the ground contact 165). The first engagement surface 445A, the second engagement surface 445B, the first ledge 415, and the second ledge 420 electrically connect the first portion 385 of the cover 380 to the first insulation displacement contact (e.g., the ground contact 165).

As shown in FIGS. 11A-11C, the cover 380 may be positioned over the ground contact 165 and the signal contact 170 and pushed down towards the electrical component 250 until the first engagement surface 445A makes contact with the flange 435 (e.g., the flange 435 rests over the first engagement surface), the second engagement surface 445B makes contact with the flange 440 (e.g., the flange 440 rests over the second engagement surface), the flange 425 makes contact with the ledge 415 (e.g., the flange 425 rests over the ledge 415), and the flange 430 makes contact with the ledge 420 (e.g., the flange 430 rests over the ledge 420). Thus, by engaging the first engagement surface 445A and the second engagement surface 445B of the cover 380 with the flanges 435 and 440, respectively, and by engaging the ledges 415 and 420 with the flanges 425 and 430, respectively, the cover 380 creates a tension against the flanges 425-440 and snaps onto the ground contact ensuring a good electrical connection between the ground contact and at least the first portion 385 of the cover. The inward biasing or taper of the first side wall 405 and the second side wall 410 of the first portion 385 further aids the compression of the coaxial cable 275 and maintains the electrical connection between the ground contact 165 and the first portion of the cover, thereby maintaining the electrical connection between the coaxial cable and the electrical component 250. Upon assembly, the top wall 400, the first side wall 405, and the second side wall 410 of the first portion 385 are sandwiched between the prongs 215/220 and the prongs 225/230. Further, upon assembly, in some embodiments, there is a small clearance between the cover 380 and the electrical component 250. In other words, in some embodiments, the cover 380 does not touch the electrical component 250.

In addition to the first portion 385, the cover 380 includes the second portion 390. The second portion 390 is intended to cover the signal contact 170. The second portion 390 is also intended to provide electromagnetic interference shielding (e.g., RF shielding) to the signal contact 170 from the ground contact 165, avoid extraneous electromagnetic signals from getting to the signal contact or for extraneous signals from the signal contact to get out. The air gap between the second portion 390 and the exposed portion 305 of the coaxial cable 275 may serve as a dielectric. The second portion 390 includes a top wall 450, a first side wall 455, and a second side wall 460. In some embodiments, since the top wall 450 is not intended to contact the coaxial cable 275, the top wall 450 may not be bowed or bent like the top wall 400 of the first portion 385. In some embodiments, the top wall 450 may have a flat (e.g., non-bowed) surface or a slightly convex surface (e.g., bulging away from the electrical component 250). Further, in some embodiments, the first side wall 455 and the second side wall 460 may not be biased towards one another. Rather, in some embodiments, the first side wall 455 and the second side wall 460 may be substantially parallel to one another.

Further, as discussed above, the retention gap 395 may be formed between the first portion 385 and the second portion 390 of the cover 380. In some embodiments, the retention gap 395 may extend from the first engagement surface 445A to the second engagement surface 445B. In some embodiments, the first engagement surface 445A may be formed between the first side wall 405 of the first portion 385 and the first side wall 455 of the second portion 390. Similarly, in some embodiments, the second engagement surface 445B may be formed between the second side wall 410 of the first portion 385 and the second side wall 460 of the second portion 390. In some embodiments, the retention gap 395 may also extend across a width of the top wall 400 all the way from the first side wall 405 to the second side wall 410. In some embodiments, the retention gap 395 may the extend across a width of the top wall 450 all the way from the first side wall 455 to the second side wall 460.

Figure 12:
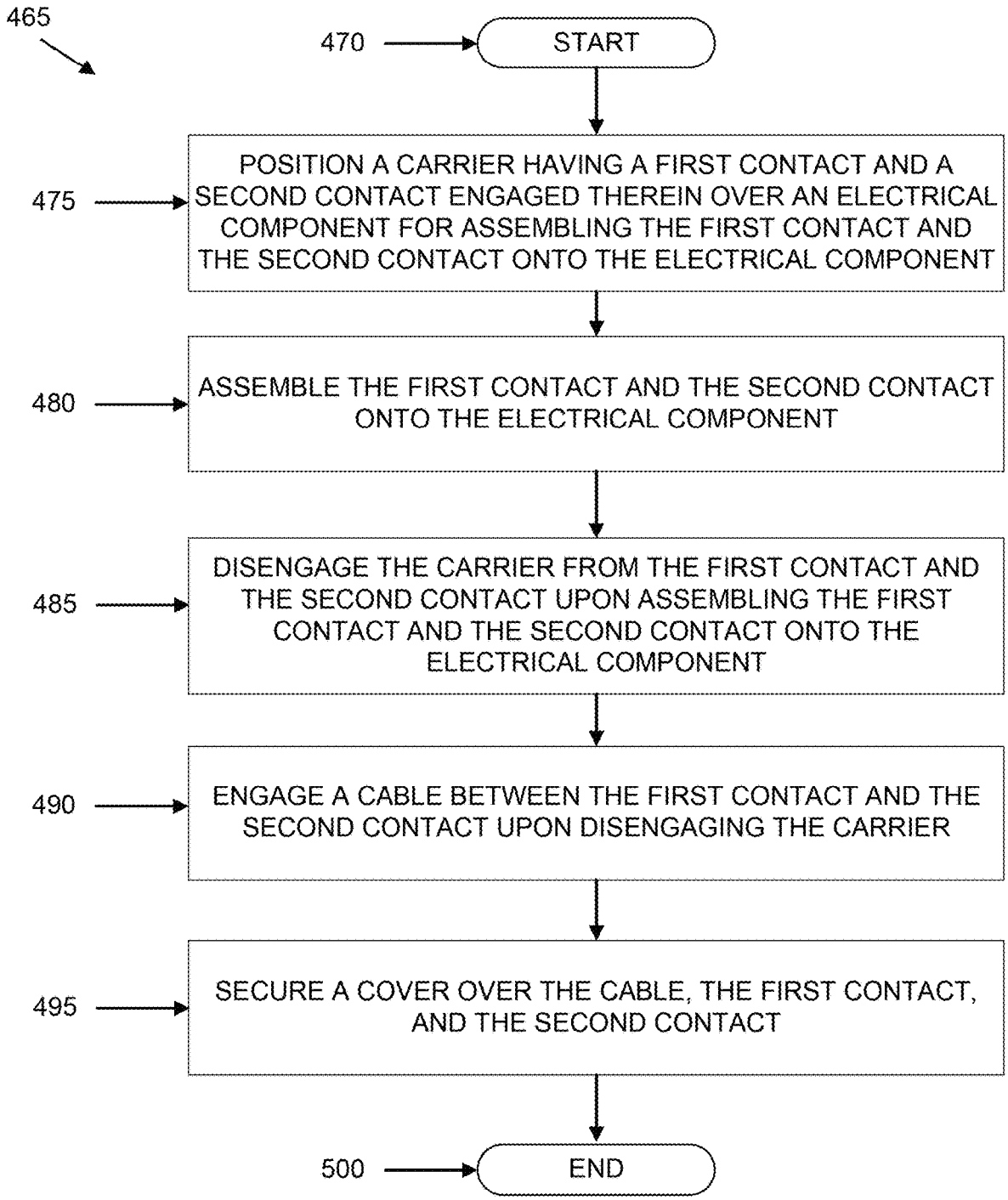
FIG. 12 is an example flowchart outlining operations for assembling the first and second IDC on the electrical component using the carrier, assembling the coaxial cable between the first and second IDC using the seating tool, and assembling the cover over the coaxial cable for electrically connecting the coaxial cable to the electrical component, in accordance with an illustrative embodiment.

Turning now to FIG. 12, an example flowchart outlining a process 465 for assembling is shown, in accordance with some embodiments of the present disclosure. The assembly starts at operation 470 with the electrical component 250 on which a first contact (e.g., the ground contact 165) and a second contact (e.g., the signal contact 170) have to be installed. The first contact (e.g., the ground contact 165) and the second contact (e.g., the signal contact 170) are secured within the retention slots 130 of the carrier 105, as discussed above in FIGS. 1A and 1B. At operation 475, the carrier 105 having the first contact (e.g., the ground contact 165) and the second contact (e.g., the signal contact 170) engaged therein is positioned over the electrical component 250 for assembling the first contact and the second contact onto the electrical component. In some embodiments, the carrier 105 having the first contact (e.g., the ground contact 165) and the second contact (e.g., the signal contact 170) secured thereto may be picked up from the pocket tape 265. At operation 480, the first contact (e.g., the ground contact 165) and the second contact (e.g., the signal contact 170) are assembled (e.g., soldered) onto the electrical component 250. At operation 485, the carrier 105 may be disengaged from the first contact (e.g., the ground contact 165) and the second contact (e.g., the signal contact 170) upon assembling the first contact and the second contact onto the electrical component.

Upon removing the carrier 105, the first contact (e.g., the ground contact 165) and the second contact (e.g., the signal contact 170) are ready to receive the coaxial cable 275. Thus, at operation 490, the coaxial cable 275 is seated or secured within the cavity 330 of the seating tool 315, as discussed above in FIG. 7. The seating tool 315 having the coaxial cable secured therein is positioned over the first contact (e.g., the ground contact 165) and the second contact (e.g., the signal contact 170), as discussed above in FIG. 8. Upon positioning the seating tool 315 over the first contact (e.g., the ground contact 165) and the second contact (e.g., the signal contact 170), the seating tool may be gently pressed downwards (e.g., downward force may be applied) towards the electrical component 250 until the coaxial cable 275 disengages from the seating tool and is inserted between the prongs 215-240 of the ground contact and the signal contact. Thus, at the operation 490, upon disengaging the carrier 105, the cable 275 is engaged between the first contact (e.g., the ground contact 165) and the second contact (e.g., the signal contact 170). Upon engaging the coaxial cable 275 with the first contact (e.g., the ground contact 165) and the second contact (e.g., the signal contact 170), the seating tool 315 is removed.

If the cover 380 is desired over the first contact (e.g., the ground contact 165) and the second contact (e.g., the signal contact 170), at operation 495, the cover is secured over the coaxial cable 275, the first contact (e.g., the ground contact 165), and the second contact (e.g., the signal contact 170), as discussed above in FIGS. 10-11C. Specifically, the cover 380 is secured over the coaxial cable 275, the first contact (e.g., the ground contact 165), and the second contact (e.g., the signal contact 170) by engaging a first ledge (e.g., the ledge 415) of the cover with a first prong (e.g., the prong 215) of the first contact, engaging a second ledge (e.g., the ledge 420) of the cover with a second prong (e.g., the prong 220) of the first contact, engaging a first engagement surface (e.g., the first engagement surface 445A) of the cover defined in the retention gap 395 between the first portion 385 and the second portion 390 of the cover with a third prong (e.g., the prong 225) of the first contact, and engaging a second engagement surface (e.g., the second engagement surface 445B) of the cover defined in the retention gap with a fourth prong (e.g., the prong 230) of the first contact. The process 465 ends at operation 500.

Thus, the present disclosure provides an easy and convenient mechanism to accurately position and connect a first IDC and a second IDC to an electrical component using a carrier. The present disclosure also provides an easy and convenient mechanism to position and engage a coaxial cable with the first IDC and second DC. A strain relief cover may be used to provide mechanism stability and RF shielding.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.) It will be further understood by those skilled in the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.) In instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.) It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An insulation displacement contact system, the system comprising:

a first insulation displacement contact;

a second insulation displacement contact; and a cover comprising a first portion over the first insulation displacement contact and a second portion over the second insulation displacement contact, wherein the cover further comprises a retention gap between the first portion and the second portion to engage the cover with a first pair of prongs of the first insulation displacement contact; and wherein the first portion of the cover comprises a first ledge and a second ledge configured to engage the cover with a second pair of prongs of the first insulation displacement contact.

2. The system of claim 1, wherein the first portion of the cover further comprises a first top wall, a first side wall, and a second side wall, wherein the first top wall comprises a bowed surface, and wherein the first side wall and the second side wall are biased towards each other.

3. The system of claim 2, wherein the second portion of the cover comprises a second top wall, a third side wall, and a fourth side wall, wherein the second top wall comprises a non-bowed surface, and wherein the third side wall and the fourth side wall are substantially parallel to one another.

4. The system of claim 3, wherein the retention gap comprises a first engagement surface between the first side wall and the third side wall and a second engagement surface between the second side wall and the fourth side wall.

5. The system of claim 4, wherein the retention gap extends from the first engagement surface to the second engagement surface.

6. The system of claim 4, wherein a first prong of the first pair of prongs comprises a first flange and a second prong of the first pair of prongs comprises a second flange, and wherein the first flange is configured to rest over the first engagement surface and the second flange is configured to rest on the second engagement surface to secure the cover with the first insulation displacement contact and the second insulation displacement contact.

7. The system of claim 4, wherein the first engagement surface, the second engagement surface, the first ledge, and the second ledge electrically connect the first portion of the cover to the first insulation displacement contact.

8. The system of claim 1, wherein a first prong of the second pair of prongs comprises a first flange that is configured to rest over the first ledge of the cover and a second prong of the second pair of prongs comprises a second flange that is configured to rest over the second ledge of the cover.

9. The system of claim 1, wherein the first insulation displacement contact is a ground contact, and wherein the second insulation displacement contact is a signal contact.

10. A cover for an electrical contact, the cover comprising:

a first portion having a first top wall, a first side wall, and a second side wall;

a second portion having a second top wall, a third side wall, and a fourth side wall; and a retention gap between the first portion and the second portion, wherein the first portion is configured to be assembled over a first contact connected to an electrical component;

wherein the second portion is configured to be assembled over a second contact connected to the electrical component;

wherein the first side wall comprises a first ledge opposite the retention gap, and wherein the first ledge is configured to engage with a first flange of the first contact; and wherein the second side wall comprises a second ledge opposite the retention gap, wherein the second ledge is configured to engage with a second flange of the first contact, and wherein the retention gap comprises a first engagement surface between the first side wall and the third side wall and a second engagement surface between the second side wall and the fourth side wall, wherein the retention gap extends from the first engagement surface to the second engagement surface.

11. The cover of claim 10, wherein the first top wall comprises a bowed surface, and the first side wall and the second side wall are biased towards one another, to compress a portion of a cable assembled between the first contact upon assembly of the first portion over the first contact.

12. The cover of claim 10, wherein the first engagement surface is configured to rest under a third flange of the first contact and the second engagement surface is configured to rest under a fourth flange of the first contact to secure the cover over the first contact and the second contact.

13. The cover of claim 10, wherein the first engagement surface, the second engagement surface, the first ledge, and the second ledge are configured to electrically connect the first portion to the first contact upon assembly of the cover over the first contact.

14. The cover of claim 10, wherein the second top wall comprises a non-bowed surface that is configured to maintain a gap between the second top wall and a portion of a cable engaged between the second contact upon assembly of the second portion over the second contact, and wherein the third side wall and the fourth side wall are substantially parallel to one another.

15. A method comprising:

positioning a carrier having a first contact and a second contact engaged therein over an electrical component for assembling the first contact and the second contact onto the electrical component;

assembling the first contact and the second contact onto the electrical component;

disengaging the carrier from the first contact and the second contact upon assembling the first contact and the second contact onto the electrical component;

engaging a cable between the first contact and the second contact upon disengaging the carrier; and securing a cover over the cable, the first contact, and the second contact by engaging a first ledge of the cover with a first prong of the first contact, engaging a second ledge of the cover with a second prong of the first contact, engaging a first engagement surface of the cover defined in a retention gap between a first portion and a second portion of the cover with a third prong of the first contact, and engaging a second engagement surface of the cover defined in the retention gap with a fourth prong of the first contact.

16. The method of claim 15, wherein the electrical component is a printed circuit board.

17. The method of claim 15, further comprising securing the first contact and the second contact in retention slots of the carrier for engaging the first contact and the second contact with the carrier.

18. The method of claim 15, wherein engaging the cable between the first contact and the second contact comprises:

securing the cable within a cavity of a seating tool;

positioning the seating tool having the cable secured therein over the first contact and the second contact; and applying downward force to the seating tool towards the electrical component, wherein the downward force transfers the cable from the cavity of the seating tool to the first contact and the second contact.

19. The method of claim 15, wherein the first contact is a ground contact and the second contact is a signal contact.

* * * * *